United States Patent [19]

Duesterhoeft et al.

[11] 4,050,765

[45] Sept. 27, 1977

[54] UNDERWATER CABLE CONNECTOR ASSEMBLY

[75] Inventors: William C. Duesterhoeft, Austin; James E. McClain, Greenville, both of Tex.

[73] Assignee: Esco Manufacturing Company, Greenville, Tex.

[21] Appl. No.: 718,790

[22] Filed: Aug. 30, 1976

[51] Int. Cl.[2] ..... H01R 3/04

[52] U.S. Cl. ..... 339/117 R; 339/60 M

[58] Field of Search ..... 339/117 R, 117 P, 118 R, 339/12 V, 42, 60 M, 96

[56] References Cited

U.S. PATENT DOCUMENTS 3,241,095 3/1966 Phillips ..... 339/117 R

*Primary Examiner*—Roy Lake
*Assistant Examiner*—DeWalden W. Jones
*Attorney, Agent, or Firm*—Kenneth R. Glaser

[57] ABSTRACT

Disclosed is a cable connector assembly consisting of telescopically mateable male and female connector portions having means such as spirally wound insulating band around the male extension and winding tubing associated with the female receptacle for establishing an indirect, elongated fluid path to electrically isolate the situs of conductive coupling between the male and female connectors. Sealing means are provided to exclude sediment and marine life from the assembly when it is disposed underwater and cable terminator housings are connected with both male and female assemblies.

13 Claims, 5 Drawing Figures

UNDERWATER CABLE CONNECTOR ASSEMBLY

The present invention relates to electrical cable connector apparatus, more particularly to electrical isolation of high voltage conductors enveloped by an electrically conductive environment, and even more particularly to undersea cable connector assemblies.

The rapid growth of oceanographic activity, and particularly oceanographic oil exploration and production, has increased the demand for electrical equipment which is operable while submerged within the sea. As a consequence, various types of submergible cable connecting apparatus have been developed which detachably couple the cables extending from the surface-located power source with the cables connected with the submerged electrical equipment. These cable connecting assemblies typically comprise male and female connector portions to which the respective cables are preconnected and which are adapted to be telescopically coupled to effect the required power connection to the underwater equipment.

While the aforementioned class of cable connector assemblies have generally performed their intended purpose, existing designs are not entirely reliable due to problems inherent in the unique nature of the undersea environment to which they are subjected. Chief among these problems is the fact that adjacent assemblies, employed for example in a three-phase system, must not only be electrically isolated from one another, but also from the equipment itself. The salt water in which they are submerged, however, provides an electrically conductive environment which establishes a potentially dangerous short circuit path between any exposed conductive portions of the cable connector assemblies. This danger is particularly present in cable connector assemblies of the aforementioned telescoping variety since the outlet that must be provided to enable expulsion of seawater from the female receptacle as the male connector is telescoped into electrical engagement therewith established this short circuit path between the situs of electrical connection in one assembly and the situs of electrical connection in an adjacent assembly due to the ionic composition of the surrounding salt water.

An additional problem, enhanced by the enormous hydrostatic pressures acting on these assemblies, is to provide means for effectively preventing seawater from entering the assembly as the connector halves are respectively telescoped into and out of connection. This is required not only to effect reliable electrical connection within the assembly, but also to exclude from the assembly any sediment and marine life which would seriously degrade its electrical and mechanical operation and effectiveness.

Various techniques have been employed in an attempt to solve the aforementioned problems. For example, in an attempt to provide the requisite electrical isolation, the seawater exiting the female receptacle has been replaced by a dielectric or insulating fluid medium which surrounds the exposed conductive portions at the situs of electrical coupling in each of the cable connecting assemblies, while exotic seals have been employed in an attempt to exclude the seawater. To date, however, these approaches have either been too expensive or complex and have not been entirely successful in assuring reliable electrical and mechanical connection and disconnection.

It is therefore a principal object of the present invention to provide a new and improved cable connector assembly of the telescoping or plug-in type.

It is an additional object of the present invention to provide a new and improved method and apparatus for effectively electrically isolating exposed conductive portions in high voltage cable connector assemblies maintained in a conductive environment.

It is an even further object of the present invention to provide a new and improved high voltage cable connector assembly of the type to be submerged in the sea and which assures convenient and reliable mechanical and electrical interconnection of the power source and electrical equipment disposed at or near the ocean floor.

In accordance with these and other objects, each cable connector assembly of the present invention comprises a pair of male and female connectors to which the cables to be electrically coupled are respectively joined, the connectors adapted to be telescoped into disconnectable coupling engagement. Means associated with the connector assembly inhibits the current carrying capability of the fluid path between the situs of electrical connection of the mating portions and the surrounding sea.

In accordance with specifically disclosed embodiments, the geometry of this path is configured to impede the effective migration of salt water ions along the path, thereby to provide the requisite electrical isolation. Specifically, spiral shaped fluid channels are provided at the location where, and to thereby elongate the path by which, the seawater exits the female connector during the insertion of the male plug. In addition, seals are appropriately included at desired locations within the connector assembly to effectively exclude the deleterious sediment and marine life therefrom.

Additional specific features of the method and apparatus of the present invention, as well as additional objects and advantages thereof, will become more readily understood and appreciated from the following detailed description taken in connection with the accompanying drawings, in which.

The drawings are not necessarily to scale, and in some instances portions have been exaggerated in order to emphasize specific features of the invention.

Figure 1:
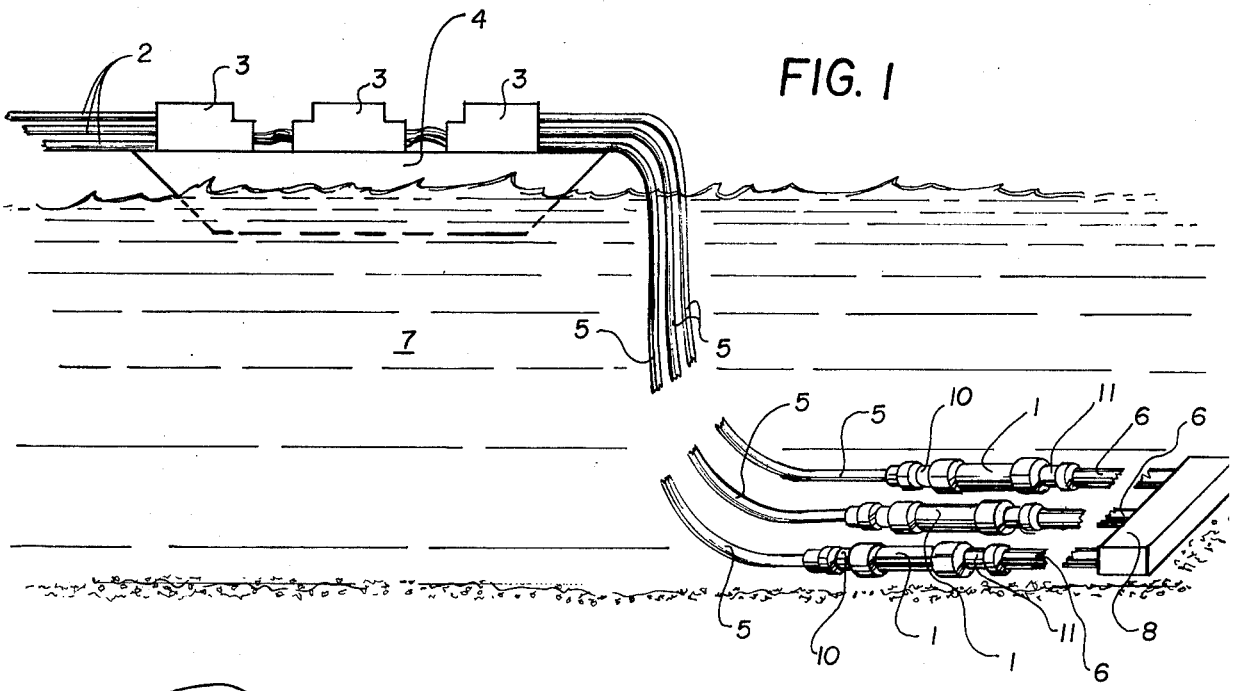
FIG. 1 is a diagrammatic representation of a set of plug-in cable connector assemblies of the present invention illustrating their use in effecting underwater electrical connection.

Referring initially to FIG. 1, the relevant portions of a typical oceanographic oil exploration installation are diagrammatically depicted. Accordingly, three-phase electrical power from a source (not shown) is coupled by way of electrical conduits 2 to suitably interconnected electrical apparatus disposed in housings schematically represented and designated by the reference numerals 3. The equipment housing 3 normally contain such conventional apparatus as transformers, protective devices, switches, etc., and may be supported upon a skid or buoy 4 at the surface of the sea 7. High voltage insulated electrical cables 5 extend from such apparatus into the depths of the ocean and are adapted to provide three-phase power (at voltages normally exceeding 2000 volts) to equipment 8 disposed at or near the ocean floor and typically at depths in excess of 5000 feet. A set of plug-in cable connector assemblies 1 constructed in accordance with the teachings of the present invention are disposed within the sea, each assembly comprising respective mateable male and female connector portions 10 and 11 and adapted to electrically interconnect the power cables 5 with insulated cables 6 extending from the equipment 8. As is therefore apparent, the cable connector assemblies 1 are not only subjected to extremely high hydrostatic pressures, but the sea in which they are immersed creates a conductive environment, as a consequence of the ionic nature of the salt water, which presents potentially dangerous short circuit and ground paths between any exposed conductive portions of adjacently disposed connector assemblies, as well as of the equipment 8.

Figure 2:
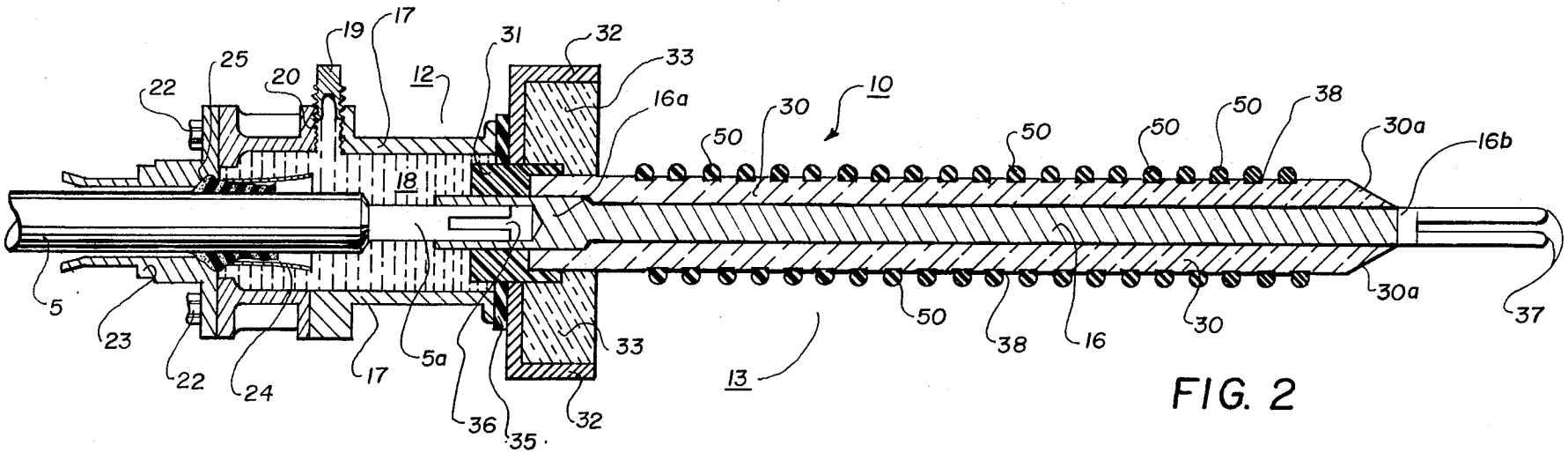
FIG. 2 is an illustration, principally in section, of a first preferred embodiment of the male connector portion of the cable connector assembly of the present invention.
Figure 3:
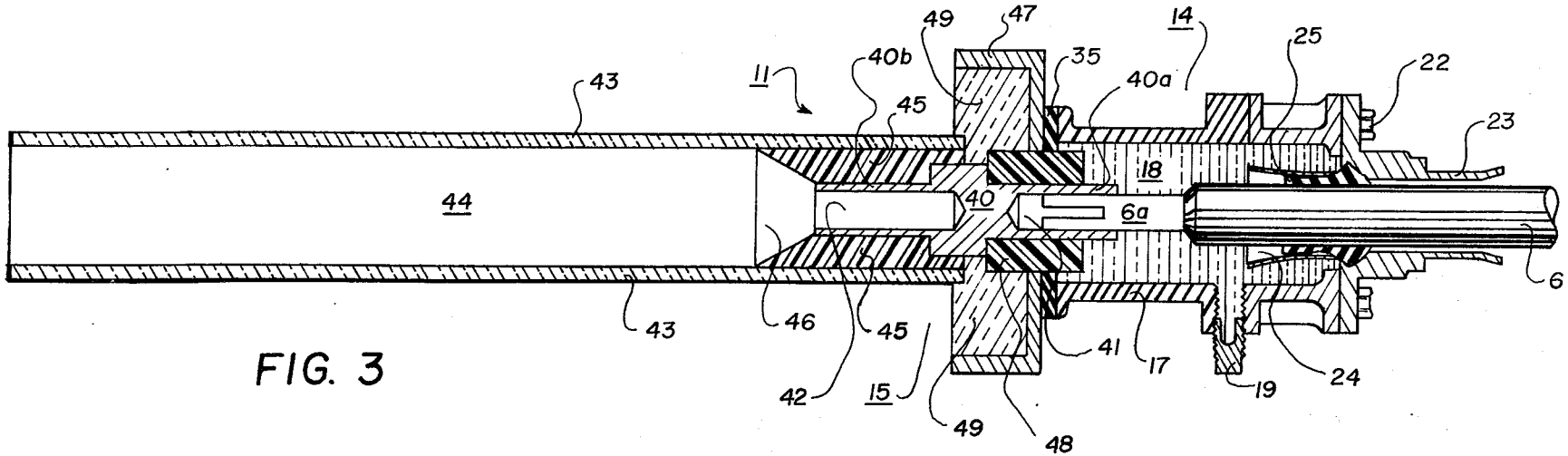
FIG. 3 is an illustration, principally in section, of a first preferred embodiment of the female connector portion of the cable connector assembly of the present invention.

Referring now to FIGS. 2 and 3, a first preferred embodiment of the plug-in cable connector assembly 1 is depicted as comprising the male connector portion 10 (FIG. 2) adapted to plug into the female connector portion 11 (FIG. 3). As subsequently described in greater detail, the end of cable 5 is so connected with male portion 10 and the end of cable 6 is so connected with female connector 11 that the telescopic coupling of these connector assembly portions establishes electrical connection between the cables 5 and 6.

The connector 10 consists of a cable terminator housing 12 connected with a plug assembly 13, the cable terminator housing 12 adapted to axially receive the prepared end of an insulated power cable 5 with the exposed conductive end **5*a* of the cable suitably connected with an end 16a of an axially extending conductive rod 16 forming part of the plug assembly 13**.

The housing 12 can be of any suitable pothead or terminator construction known in the art and employed for the receipt and interconnection of high voltage power cables. In accordance with a preferred form of such housing, the design of which is based upon the apparatus described in U.S. Pat. No. 3,721,745, assigned to the assignee of the present invention, the terminator assembly consists of a generally cylindrical main body 17 defining a hollow chamber 18 preferably prefilled with a fluid dielectric material. A port 20 in the outer wall is closed off by an externally threaded filling plug 19 and enables access to the chamber 18 so that the dielectric material may be added to or removed from the chamber as desired. Secured to the end of the body 17 (by way of fasteners 22) is a skirt or gland assembly 23 through which the cable 5 is inserted into the dielectric filled chamber past a metallic stress cone 24.

Disposed at the interface of the assemblies 23 and 17 at the entrance to chamber 18 is a seal 25 which is effective to prevent the dielectric material from leaking past the cable as it is inserted into terminator housing 12. Prior to the insertion of the cable 5, the seal 25 would normally extend completely across the cable passageway into the chamber 18 and would include a central portion which is either ruptured or displaced upon insertion of the cable. As depicted in FIG. 2, after the insertion of the cable, the lip of the seal 25 is tightly compressed against the cable body, thus insuring against leakage of the dielectric material out of the chamber 18.

The plug assembly 13 comprises an elongated cylindrically shaped body 30 of insulating material, for example of a plastic such as polyvinyl, through which the conductive rod 16, formed of copper for example, axially extends. An insulating retainer ring 31 is disposed about one end of the body 30 (and the rod 16) and is itself surrounded by a cylindrically shaped terminator mounting plate 32, the entire assembly being maintained in assembled relation (by means not shown) with potting compound or epoxy 33 disposed within the confines of plate 32, all as depicted in FIG. 2. The cable terminator housing 12 is secured (by way of gasket 35 and mounting plate 32) to the plug assembly 13 by suitable fasteners or the like (not shown).

As previously briefly mentioned, the proximal end 16a of the conductor rod 16 is of a configuration which enables the conductive male connector portion **5*a* of cable 5 to be secured thereto. For example, and as specifically illustrated in FIG. 2, this end may be formed with a centrally disposed socket 36 which mateably receives the connector portion 5*a* of the cable. The distal end 16*b* of the conductor 16 protrudes from the corresponding end of the insulating body 30 and terminates in a set of conductive prongs 37 adapted to plug into a corresponding receptacle in the female connector 11**, as subsequently described.

Referring now to FIG. 3, the female connector portion 11 includes a cable terminator housing 14 joined with a female receptacle assembly 15 adapted to detachably and telescopically receive the plug assembly 13 of the male connector portion 10. The cable terminator housing 14 is of the same construction as the cable terminator housing 12 (identical reference numerals therefore being employed to refer to similar or corresponding parts); and in the manner similar to that described with reference to the cable 5, the housing 14 receives the prepared end of cable 6 extending from the underwater apparatus 8.

The assembly 15 consists of a centrally disposed conductive connector or stud 40 having, at one end thereof, a projection **40*a* defining a socket 41 for receipt of the conductive extension 6*a* of the cable 6. Similarly, the opposed end of the stud 40 is formed as a cylindrically shaped projection 40*b* whose walls define a cavity 42 of a size and configuration adapted to receive the conductive prongs 37 of the rod 16. The cylindrically shaped projection 40*b* axially extends within the confines of an elongated cylindrically shaped thin walled plastic tube or sleeve 43, the inner diameter of which is slightly greater than the outside diameter of the body 30 and the length of which is slightly less than the length of body 30. The circumferentially extending wall of plastic tube 43 defines an open cavity 44 for receiving the elongated body 30** in the manner subsequently described.

Disposed around the extension 40b is an insulating guide sleeve 45 having an opening 46 at one end with a tapered wall corresponding to the tapered end **30*a* of probe 30 with its opposed end extending (along with the end of the tube 43) into the confines of a terminator mounting plate 47. An insulating retainer bushing 48 disposed around the main body of the conductive stud 40 extends through the plate 47 with potting compound or epoxy 49 completely filling the gap in the plate 47. In a manner similar to that previously described, the entire assembly is in assembled relationship with terminator housing 14 secured by way of gasket 35 and terminator mounting plate 47 with the female assembly 15**.

Figure 4:
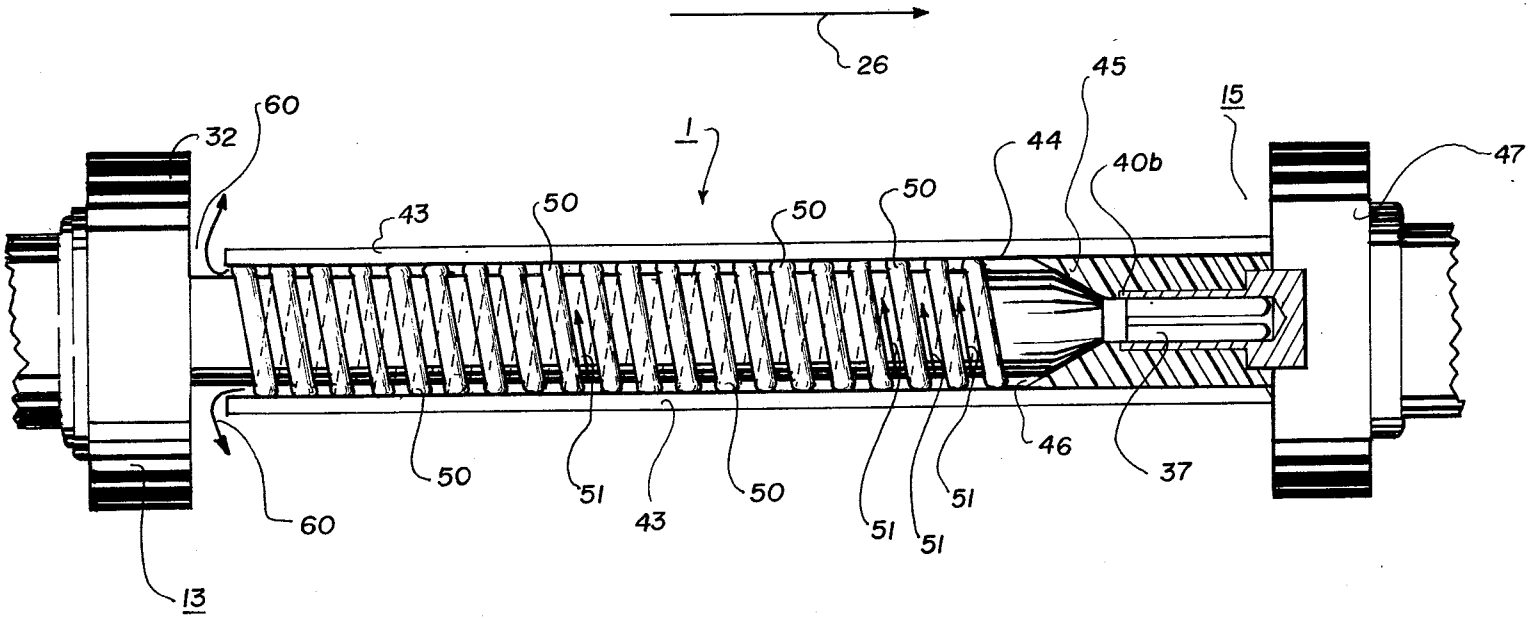
FIG. 4 is a pictorial view illustrating the telescopic coupling engagement of the male and female connector portions shown in FIGS. 2 and 3.

In accordance with a unique feature of the present invention, and with reference now to both FIGS. 2 and 4, a continuous band 50 is disposed in a spiral configuration around the circumference of the male plug body 30, the band continuously extending from a point immediately adjacent the tip of distal end 16*b* thereof to a location adjacent the epoxy filled plate 32. The spiral band, which is preferably of a resilient insulating material such as neoprene, is of a dimension that enables its continuous sliding and sealing contact with the inner wall of the plastic tube 43 as the male plug body 30 is inserted into the tube 43. The band 50 may be secured to the body 30 by adhesively securing same within a corresponding helical shaped groove 38 cut into the outer circumference of the body.

Referring particularly to FIG. 4, it will be observed that as the male and female plug assemblies 13 and 15 are joined (by inserting probe 30 into tube 43 in direction of arrow 26), the seawater within the cavity 44 is displaced and constrained to travel along a helical path (illustrated by the arrows 51) between the loops of the band 50 where it exits the open end of tube 43. As a consequence, the length of the path between the situs of conductive coupling of the prongs 37 (of the male connector 10) with the conductive extension 40*b* (of female connector 11) and the situs 60 (the gap where the seawater exits when the cable connector assembly 1 is fully coupled) has effectively been lengthened in accordance with the number of convolutions of the spiral band 50.

The result is therefore to inhibit the ionic migration along, and to effectively increase the resistance of, this path, thereby effectively electrically isolating the exposed conductors 37 and 40*b* from the outside world. It is also theorized that a contributing factor to this electrical isolation is that the gaseous products (such as chlorine gas) of electrolysis occurring within the tube chamber are trapped within the confined path between the band loops adjacent the situs of conductive coupling, thus further inhibiting electrical current flow.

Besides providing the previously described electrical isolation, the spiral band 50 additionally provides an effective seal against the introduction of sediment or marine life into the elongated chamber 44 during the coupling and uncoupling of the connector portions.

The use and operation of the plug-in cable connector assembly of the present invention is now described. Accordingly, the prepared end of the power cable 5 and the prepared end of the cable 6 are respectively inserted into the terminator housings of the male and female portions 10 and 11 as illustrated in FIGS. 2 and 3. Each of the assemblies 1 (FIG. 1) in their uncoupled condition are then submerged within the sea, during which time, of course, the power is interrupted to the cables 5. Subsequently, the elongated body 30 of the male connector 10 is inserted into the cavity 44 of the female connector tube 43 to urge the prongs 37 into tight electrical connection with the conductive projection 40*b*, it being noted (FIG. 4) that the tapered end 30*a* is guided into position by the corresponding tapered opening 46 of the guide sleeve 45, the seawater previously trapped within the tube 43 being expelled therefrom in the manner previously described. With the male and female portions 10 and 11 being fully joined, the power can now be supplied to apparatus 8, since electrical communication exists between cable end 5*a*, conductive rod 16 (and prongs 37), conductive stud 40, and cable end 6*a*.

Figure 5:
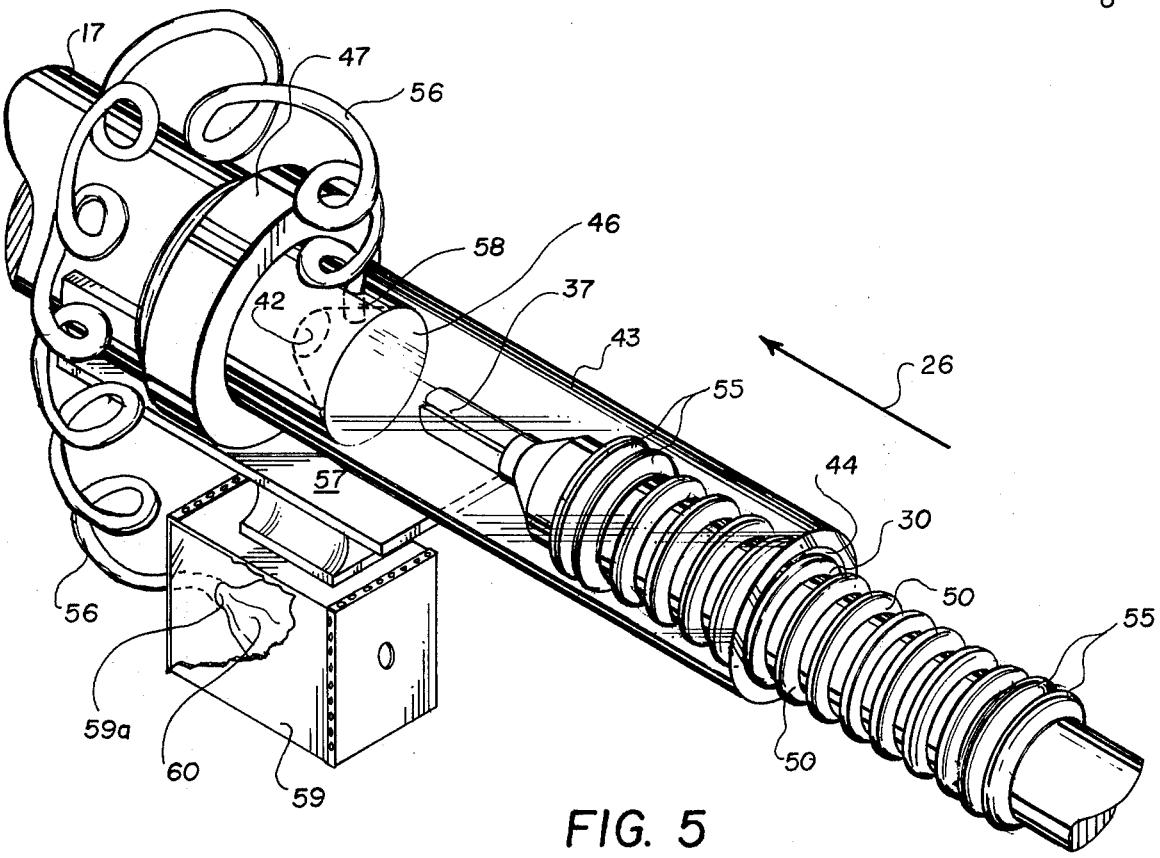
FIG. 5 is an illustrative depiction of an alternate embodiment of the cable connector assembly of the present invention.

Referring now to FIG. 5, an alternate embodiment of the plug-in cable connector assembly of the present invention is depicted. Accordingly, the male and female connector portions 10 and 11 would be of substantially the same construction as that previously described with reference to FIGS. 2 – 4. In this embodiment, however, rather than just providing the spiral band 50 around the male probe body 30, a hollow plastic tubing 56 formed in a winding path is additionally provided with one open end thereof in fluid communication with the cavity 44 of the plastic sleeve 43 at a location immediately adjacent the end of the tube 43 (near the mounting plate 47). For example, as illustrated in FIG. 5, the one end of the tubing 56 can extend through aligned openings within the outer wall of the tube 43 and sleeve 45 into the tapered opening 46. The opposed end of the tubing 56 can then be open to the sea or, as depicted in FIG. 5, extend into fluid communication with the inside of an expandable bladder or diaphram 60 disposed within a conventional pressure regulator housing 59 (through the opening 59*a*). The bladder 60 than additionally functions as a filter to exclude sediment and marine life from the assembly. The housing 59 may be mounted in any suitable manner with the cable terminator housing body 17 as, by way of example, a bracket 57.

In this embodiment, the spiral band 50 is located between spaced sets of conventional O-rings 55 disposed along the body (as depicted in FIG. 5); the insertion of the probe body 30 in the direction of arrow 26 then forces seawater within the tube 43 into the tapered opening 46 where it thereafter exits the assembly through the winding tubing 56 into bladder 60 with the band 50 providing an elongated fluid path in the direction toward the opening of tube 43. The purpose of the tubing 56 is essentially the same as for the spiral band 50, i.e. to provide an elongated path between the situs of electrical coupling of the male and female connector portions and the outside world. Furthermore, the sealing O-rings 55 on the tube 30 (as well as the bladder 60) prevent sediment or marine life from entering the cable connector assembly.

Various modifications to the disclosed embodiments may become apparent to one skilled in the art. For example, it would be possible to shorten the overall length of the spiral band 50 as well as the tubing 56 by narrowing the spacing between convolutions (in the case of the band 50) or diminishing the diameter of the tubing 56. As may be apparent, this also has the effect of increasing the resistance of the fluid path between the situs of conductive coupling and the outside world. Additionally, the tubing 56 can be wound around an externally excited magnetic core so that the induced voltage within the tubing would be equal and opposite to that existing, thus inhibiting current flow therein.

Various modifications to the disclosed embodiments, as well as alternate embodiments, of the present invention may become apparent to one skilled in the art without departing from the spirit and scope of the invention as defined by the appended claims.

What is claimed is:

1. Electrical cable connector assembly, comprising:

a. male connector means comprising an elongated body of insulating material with a conductive rod axially extending therethrough, one end of said conductive rod adapted to be joined with the conductive end of a first insulated power cable, the opposed end of said conductive rod terminating in a prong assembly, b. female connector means adapted for mateable coupling with said male connector means, said female connector means comprising a hollow insulating sleeve defining an elongated chamber therein and adapted to telescopically receive the elongated body of said male connector means at one open end thereof, means adapted to be joined with the conductive end of a second insulated power cable, and conductive socket means disposed within said hollow insulating sleeve at a location remote from said one open end adapted to receive said prong assembly in conductive coupling relationship, and c. means connected with said male connector means for establishing an indirect fluid path through said elongated chamber between said open end and the situs of conductive coupling of said prong assembly and said conductive socket means, whereby fluid exiting said chamber at said open end when said male and female connectors are mateably coupled is constrained to travel along said indirect fluid path.

2. Electrical cable connector assembly, comprising:

a. male connector means comprising an elongated body of insulating material with a conductive rod axially extending therethrough, one end of said conductive rod adapted to be joined with the conductive end of a first insulated power cable, the opposed end of said conductive rod terminating in a prong assembly, b. female connector means adapted for mateable coupling with said male connector means, said female connector means comprising a hollow insulating sleeve adapted to telescopically receive the elongated body of said male connector means at one open end thereof, means adapted to be joined with the conductive end of a second insulated power cable, and conductive socket means disposed within said hollow insulating sleeve at a location remote from said one open end adapted to receive said prong assembly in conductive coupling relationship, c. means for establishing a first indirect fluid path through a chamber defined by said sleeve between said open end and the situs of conductive coupling of said prong assembly and said conductive socket means when said male and female connectors are mateably coupled, and d. means for establishing a second indirect fluid path extending from the said situs of conductive coupling through said hollow insulating sleeve to a location disposed at the outside of said hollow insulating sleeve.

3. The cable connector assembly as defined by claim 2 further comprising means for preventing sediment from entering the chamber defined by said hollow insulating sleeve.

4. Electrical cable connector assembly, comprising:

a. male connector means comprising an elongated body of insulating material with a conductive rod axially extending therethrough, one end of said conductive rod adapted to be joined with the conductive end of a first insulated power cable, the opposed end of said conductive rod terminating in a prong assembly, b. female connector means adapted for mateable coupling with said male connector means, said female connector means comprising a hollow insulating sleeve defining a chamber therein and adapted to telescopically receive the elongated body of said male connector means at one open end thereof, means adapted to be joined with the conductive end of a second insulated power cable, and conductive socket means disposed within said hollow insulating sleeve at a location remote from said one open end adapted to receive said prong assembly in conductive coupling relationship, and c. means for establishing a winding fluid path between the situs of conductive coupling of said prong assembly and said conductive socket means and a location outside of said hollow insulating sleeve, whereby fluid exiting the said chamber during the mateable coupling of said male and female connector means is constrained to travel along said winding fluid path.

5. Electrical cable connector assembly, comprising:

a male connector means comprising an elongated body of insulating material with a conductive rod axially extending therethrough, one end of said conductive rod adapted to be joined with the conductive end of a first insulated power cable, the opposed end of said conductive rod terminating in a prong assembly, b. female connector means adapted for mateable coupling with said male connector means, said female connector means comprising a hollow insulating sleeve adapted to telescopically receive the elongated body of said male connector means at one open end thereof, means adapted to be joined with the conductive end of a second insulated power cable, and conductive socket means disposed within said hollow insulating sleeve at a location remote from said one open end adapted to receive said prong assembly in conductive coupling relationship, and c. A continuous band of insulating material disposed in a spiral configuration around the circumference of the elongated body of said male connector means, said insulating band establishing an indirect fluid path through the chamber defined by said sleeve, thereby to effectively electrically isolate the situs of conductive coupling of said prong assembly and said conductive socket means when said male and female connectors are mateably coupled.

6. The assembly as defined by claim 5 wherein said band is secured with said elongated body in a corresponding helical shaped groove extending around the outer circumference of said elongated body.

7. The apparatus as defined by claim 5 further comprising first and second terminator housings respectively connected with said male and female connector means and surrounding the conductive ends of said first and second insulated power cables.

8. Electrical cable connector assembly, comprising:

a. male connector means comprising an elongated body of insulating material with a conductive rod axially extending therethrough, one end of said conductive rod adapted to be joined with the conductive end of a first insulated power cable, the opposed end of said conductive rod terminating in a prong assembly, b. female connector means adapted for mateable coupling with said male connector means, said female connector means comprising a hollow insulating sleeve adapted to telescopically receive the elongated body of said male connector means at one open end thereof, means adapted to be joined with the conductive end of a second insulated power cable, and conductive socket means disposed within said hollow insulating sleeve at a location remote from said one open end adapted to receive said prong assembly in conductive coupling relationship, and c. tubing formed in a winding path and extending through said hollow insulating sleeve to be in fluid communication with the chamber defined by said sleeve at a location immediately adjacent the situs of conductive coupling of said prong assembly and said conductive socket means, said tubing establishing an indirect fluid path between said situs and a location outside of said hollow insulating sleeve.

9. The apparatus as defined by claim 8 wherein the opposed end of said tubing extends into fluid communication with the inside of an expandable bladder.

10. The assembly as defined by claim 8 further comprising first and second terminator housing respectively connected with said male and female connector means and surrounding the conductive ends of said first and second insulated power cables.

11. In an underwater cable connector assembly of the type comprising a plurality of sets of cable connectors disposed adjacent one another in an underwater environment, each of said sets of cable connectors comprising male and female connector means adapted to be coupled with one another at a site of conductive coupling, the improvement comprising sinuous means disposed in the fluid path between adjacent conductive coupling sites to effectively lengthen said fluid path and inhibit electrical conduction along said path.

12. Electrical cable connector assembly, comprising:

a. female connector means comprising a hollow insulating sleeve defining a chamber therein, conductive socket means disposed within the confines of said insulating sleeve, and means for electrically connecting said conductive socket means with the conductive end of a first power cable, b. male connector means adapted for mateable coupling with said female connector means, said male connector means comprising an elongated conductive rod having one end adapted to be joined with the conductive end of a second power cable, the opposed end of said conductive rod adapted for conductive coupling relationship with said conductive socket of said female connector means, and c. a continuous band of insulating material disposed in a spiral-like configuration around said elongated conductive rod, said continuous band establishing an indirect fluid path through said chamber, thereby to effectively electrically isolate the situs of conductive coupling of said conductive rod and said conductive socket means when said male and female connectors and mateably coupled.

13. Electrical cable connector assembly, comprising:

a. female connector means comprising a hollow insulating sleeve defining a chamber therein, conductive socket means disposed within the confines of said insulating sleeve, and means for electrically connecting said conductive socket means with the conductive end of a first power cable, b. male connector means adapted for mateable coupling with said female connector means, said male connector means comprising an elongated conductive rod having one end adapted to be joined with the conductive end of a second power cable, the opposed end of said conductive rod adapted for conductive coupling relationship with said conductive socket of said female connector means, and c. tubing formed in a winding path and extending through said insulating sleeve to be in fluid communication with said chamber at a location immediately adjacent the situs of conductive coupling of said conductive rod and said conductive socket means, said tubing establishing an indirect fluid path between said situs at a location outside of said insulating sleeve.

* * * * *